US006347935B1

(12) United States Patent
Schindler et al.

(10) Patent No.: US 6,347,935 B1
(45) Date of Patent: Feb. 19, 2002

(54) LOW $NO_X$ AND LOW CO BURNER AND METHOD FOR OPERATING SAME

(75) Inventors: Edmund Schindler, Fairfield, CT (US); Lev Tsirulnikov, Brooklyn, NY (US); John Guarco, Wolcott; Jon Moore, Hamden, both of CT (US); Michael Gamburg, San Francisco, CA (US)

(73) Assignee: John Zink Company, L.L.C., Tulsa, OK (US)

( * ) Notice: Subject to any disclaimer, the term of this patent is extended or adjusted under 35 U.S.C. 154(b) by 0 days.

(21) Appl. No.: 09/335,007

(22) Filed: Jun. 17, 1999

Related U.S. Application Data

(60) Provisional application No. 60/089,570, filed on Jun. 17, 1998.

(51) Int. Cl.[7] ..... F23D 14/02; F23M 3/00

(52) U.S. Cl. ..... 431/5; 431/9; 431/116; 431/164; 431/166; 431/174; 431/182; 431/188; 431/190

(58) Field of Search ..... 431/5, 9, 8, 115, 431/116, 159, 160, 164, 166, 168, 174, 178, 181, 182, 183, 185, 187, 188, 190, 354; 126/79; 110/204, 205, 212, 213, 214

(56) References Cited

U.S. PATENT DOCUMENTS

| | | | | | |
|---|---|---|---|---|---|
| 4,004,875 | A | * | 1/1977 | Zink et al. | 431/9 |
| 4,060,379 | A | * | 11/1977 | LaHaye et al. | 431/9 |
| 4,130,388 | A | * | 12/1978 | Flanagan | 431/116 |
| 4,575,332 | A | * | 3/1986 | Oppenberg et al. | 431/9 |
| 4,708,637 | A | * | 11/1987 | Dutescu | 431/116 |
| 4,708,638 | A | * | 11/1987 | Brazier et al. | 431/116 |
| 4,815,966 | A | * | 3/1989 | Janssen | 431/115 |
| 4,925,387 | A | | 5/1990 | Locanetto et al. | 431/187 |
| 5,413,477 | A | * | 5/1995 | Moreland | 431/9 |
| 5,624,253 | A | * | 4/1997 | Sulzhik et al. | 431/116 |
| 5,634,785 | A | | 6/1997 | Bury et al. | 431/9 |
| 5,860,803 | A | | 1/1999 | Schindler et al. | 431/9 |

FOREIGN PATENT DOCUMENTS

| | | | |
|---|---|---|---|
| GB | 3048201 | | 8/1982 |
| JP | 52-22134 | | 2/1977 |
| JP | 55023869 | | 2/1980 |
| JP | 57-26308 | | 12/1982 |
| JP | 6-193823 | * | 7/1994 |

* cited by examiner

*Primary Examiner*—Ira S. Lazarus
*Assistant Examiner*—Josiah C. Cocks
(74) *Attorney, Agent, or Firm*—James H. Marsh, Jr.; Shook, Hardy & Bacon LLP

(57) ABSTRACT

A round burner capable of being operated with reduced CO and $NO_x$ emissions includes a venturi tube positioned to direct a flow of air through the burner and into a combustion zone in a combustion chamber through an entrance in a wall of the combustion chamber. The venturi tube has inlet and outlet ends and a throat. The outlet end of the venturi tube has a larger internal diameter than either the inlet end or the throat and the same is positioned adjacent the entrance to the combustion chamber. The inlet end of the venturi tube is also positioned further from the entrance than the outlet end of the venturi tube. The burner may include a duct system that includes an inlet disposed in fluid communication with the combustion zone and an outlet disposed in fluid communication with the venturi tube adjacent the throat thereof. The system is arranged and adapted to recirculate a stream of flue gas from a location within said combustion chamber adjacent the combustion zone by induction into the venturi tube at a low pressure location adjacent the throat of the venturi tube so that the recirculated stream of internal flue gas is inducted into and intermixed with the flow of air at the throat of the venturi tube. Alternatively or cumulatively, the burner may include a fuel gas injector arrangement having an injector nozzle extending through the wall at a location adjacent the combustion zone. The injector nozzle is in fluid communication with the combustion chamber and is positioned to direct a flow of fuel gas into the combustion chamber at a location in the wall radially beyond the inner edge of the entrance. Also disclosed is a method for operating the burner to reduce CO and $NO_x$ emissions.

64 Claims, 7 Drawing Sheets

LOW $NO_X$ AND LOW CO BURNER AND METHOD FOR OPERATING SAME

CROSS REFERENCE TO RELATED APPLICATIONS

This application is based at least in part on the disclosure of provisional application Ser. No. 60/089,570 filed on Jun. 17, 1998 and priority under 35 U.S.C. §119(e) is claimed from such provisional application. The entirety of the disclosure of said provisional application is hereby incorporated herein be reference.

BACKGROUND OF THE INVENTION

1. Field of the Invention

The invention of the present application relates to burners for large scale industrial applications. Such burners may be adapted for burning gaseous fuels including natural gas. Such burners may also be adapted for burning fuel oil. And in many cases the burners may be adapted for burning both gaseous fuels and fuel oil either alternatively or at the same time. In particular the invention relates to industrial burners which burn fuel gas and/or oil and are specially constructed and engineered for emitting low levels of nitrogen oxide ($NO_x$) and carbon monoxide (CO) air pollution. The invention also relates to the methodology for operating such burners. More particularly the invention relates to a burner and the methodology for operating the same whereby substantial reductions of CO and $NO_x$ emissions are achieved relative to existing burners.

2. The Prior Art Background

Many designs exist for delivering fuel and air to a furnace combustion chamber or firebox. Virtually all modern prior art designs are intended to enhance combustion efficiency. In addition, tube metal temperatures and other furnace component limitations must be taken into consideration in designing furnace burners. More recently governmental regulations and social pressures require designers to take into consideration the reduction of CO and $NO_x$ emissions.

One of the best of the more recently developed industrial burners is the Todd Variflame No Internal FGR Injection and No External Gas Injection Burner which uses an array of internal poker tubes for delivering fuel and air to a furnace firebox. This system is the subject matter of U.S. Pat. No. 5,860,803 to Schindler et al. which issued on Jan. 19, 1999 (the "'803 patent"). The entirety of the disclosure of the '803 patent is hereby incorporated herein by reference.

In spite of the efforts of many prior art workers in the field, a perfect solution to the CO and $NO_x$ emissions problem remains elusive. Some have tried to reduce $NO_x$ emissions by recirculating flue gas into the firebox. However, when flue gas is recirculated from a downstream location, the costs associated with providing and forcing such recirculation are substantial.

SUMMARY OF THE INVENTION

The present invention provides a device and methodology for efficiently and economically reducing the amount CO and $NO_x$ emission from a combustion chamber without substantially effecting thermal efficiency and/or reaction parameters of the same. In particular the invention provides a novel burner design and novel operating methodology which utilizes internal flue gas recirculation and/or external fuel injection in a venturi tube burner system. More particularly, the invention provides a venturi tube burner system which provides swirled primary and straight line secondary combustion air in the venturi tube and straight line tertiary air outside the venturi tube to provide novel effects in the burner flame formed under the above conditions. Preferably the burner includes internal flue gas recirculation and/or external fuel injection.

As a result of extensive research and development conducted by the present inventors, an improved burner design has been developed whereby it is possible to achieve substantial reductions in CO and $NO_x$ emissions without substantial loss of burner efficiency. Thus, in accordance with one aspect of the present invention, a novel round burner is provided which comprises a venturi tube positioned to direct a flow of air through the burner and into a combustion zone in a combustion chamber through an entrance in a wall of the combustion chamber. The venturi tube has inlet and outlet ends and a throat located between the inlet and outlet ends. The outlet end has a larger internal diameter than either the inlet end or the throat. The outlet end of the venturi tube is positioned adjacent the entrance to the combustion chamber and the inlet end of the venturi tube is positioned further from the entrance than the outlet end.

The novel burner of the invention also provides a duct system that includes at least one inlet disposed in fluid communication with the combustion zone, and at least one outlet disposed in fluid communication with the throat of the venturi tube. The duct system is arranged and adapted to recirculate flue gas from a location within said combustion chamber adjacent said combustion zone and into said venturi tube at a location adjacent said throat, whereby the recirculated flue gas is inducted into and intermixed with said flow of air at said throat of the venturi tube. Thus, $NO_x$ emission reduction may be achieved without the expense of an external flue gas recirculation system.

In another aspect of the invention, the invention provides a round burner which comprises a venturi tube positioned to direct a flow of air through the burner and into a combustion zone in a combustion chamber through an entrance in a wall of the combustion chamber. The novel burner of this aspect of the invention includes a fuel gas injector arrangement including at least one injector nozzle extending through the wall of the combustion chamber at a location adjacent said combustion zone. Such injector nozzle is in fluid communication with the combustion chamber. The injector nozzle is positioned to direct a flow of fuel gas into said combustion chamber at a location in the wall radially outward of and beyond the inner edge of the entrance.

In yet another aspect of the invention, the novel burner may include both the duct system for recirculated flue gas and the fuel gas injector arrangement described above.

In its more specific aspects, the burner of the present invention may include a first fuel gas nozzle that is located in the venturi tube and which is positioned to introduce a supply of fuel gas into the air flowing through the venturi tube. The burner may also include a swirler positioned so that at least a primary portion of the air flow passes therethrough. Ideally the arrangement of the outlet end of the venturi tube and the swirler may be such that a secondary portion of the air flow does not pass through the swirler. Even more ideally, an annular gap may be provided between the outer periphery at the outlet end of the venturi tube and an inner edge of said entrance. Such gap may be positioned to direct a tertiary air flow around the periphery of the venturi tube and through the entrance into said combustion chamber.

Preferably, at least one first fuel gas nozzle may be positioned centrally of the venturi tube adjacent a longitudinal axis thereof and at a location to introduce fuel gas into said primary portion of the flow of air. At least one fuel gas poker nozzle may also be included at a position to introduce fuel gas into said secondary portion of the flow of air.

The burner of the invention may be equipped to burn either fuel gas or oil.

The invention also provides a method for operating a venturi tube equipped round burner of the sort described above. In accordance with this aspect of the invention, the method comprises directing a flow of air through said venturi tube and into a combustion zone in said combustion chamber through said entrance and recirculating flue gas from a location in said combustion chamber adjacent said combustion zone and into the venturi tube at a location adjacent the throat of the venturi tube, whereby said recirculated flue gas is inducted into and intermixed with the combustion air flow at the low pressure throat of the venturi tube.

In another aspect of the invention, the method may comprise directing a flow of air through the venturi tube and into a combustion zone in a combustion chamber through an entrance in a wall of the combustion chamber and injecting a flow of fuel gas into said combustion chamber at a location radially outward and beyond the inner edge of the entrance and adjacent to said combustion zone. Furthermore, the novel method may include both the recirculation of flue gas and external fuel gas injection as described above.

In a more specific sense, the method may include a step of introducing a first supply of fuel gas into said flow of air. The method also may include a step of passing at least a primary portion of said flow of air through a swirler. Even more specifically, the method may be such that a secondary portion of said flow of air does not pass through the swirler.

In another important preferred aspect of the invention, the method may include a step of causing a tertiary air stream to flow around the periphery of the venturi tube, through a gap provided between the large end of the venturi tube and an inner edge of the entrance to the combustion chamber, and on into the combustion zone.

In another preferred aspect of the invention, the method for operating a venturi equipped round burner may include a step of introducing a first supply of fuel gas into the primary portion of the flow of air, and introducing a second separate supply of fuel gas into said secondary portion of the flow of air.

DETAILED DESCRIPTION OF THE PREFERRED EMBODIMENTS

Figure 1:
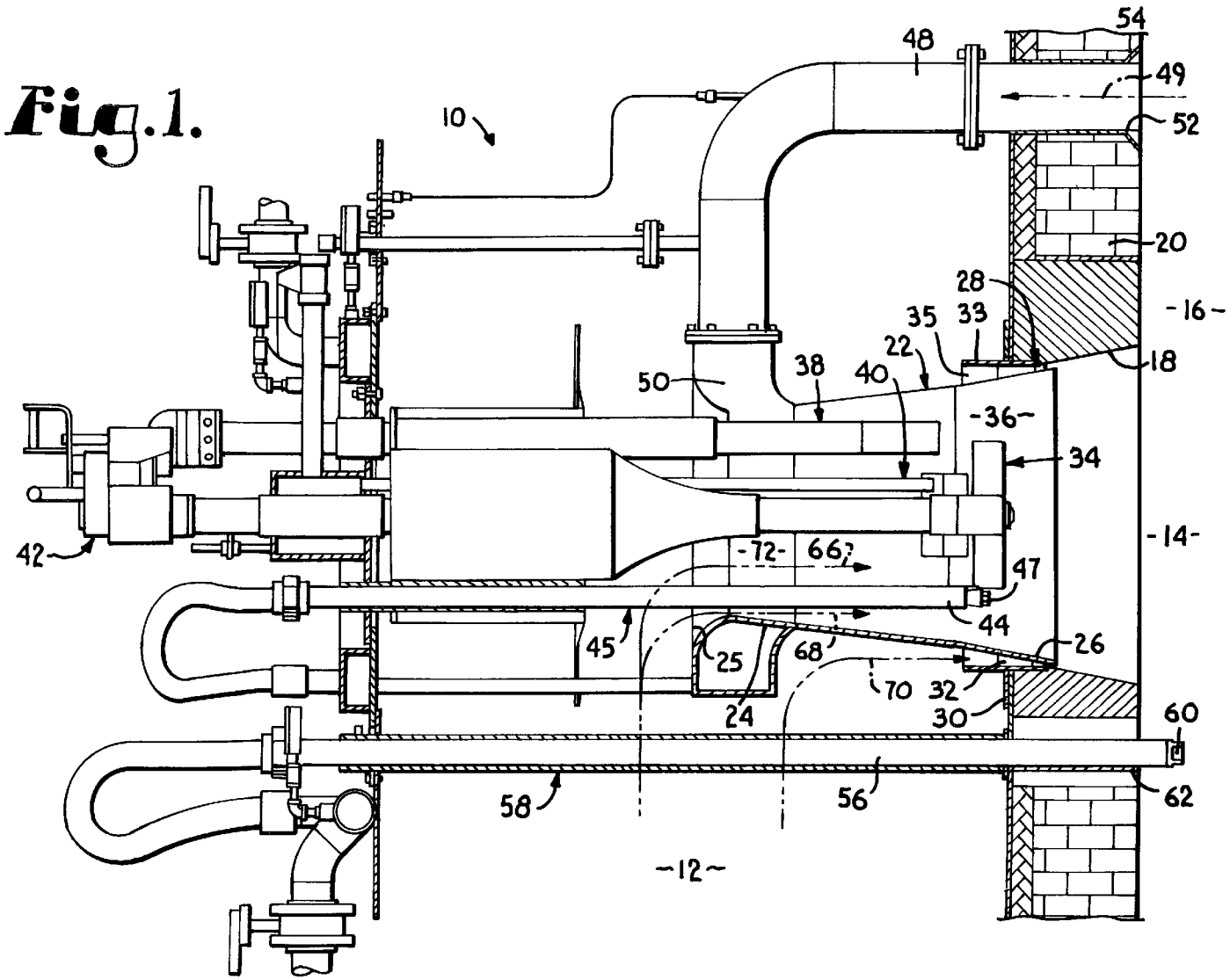
FIG. 1 is a sectional elevational view of an embodiment of a combustion chamber burner of the invention and its associated elements taken essentially along the vertical centerline of the combustion chamber windbox.

A burner assembly which embodies the features, concepts and principles of the invention is illustrated in FIG. 1 where it is identified by the reference numeral 10. As is conventional and well known to those of ordinary skill in the relevant art, the burner 10 may be surrounded by a windbox 12 which provides combustion air to the burner at a pressure sufficient to cause it to flow into the combustion zone 14 in a combustion chamber or firebox 16 through an entrance 18 in a wall 20 of the combustion chamber 16. As is also well known to those of ordinary skill in the art, an entrance, such as the entrance 18, may preferably be in the form of a generally circular opening which extends through the wall 20 of combustion chamber 16.

The burner 10 is equipped with an elongated venturi tube 22 having an inlet end 25 that is spaced from entrance 18 and a outlet end 26 that is positioned adjacent to and in alignment with entrance 18. The venturi tube 22 also has a throat 24 disposed between inlet end 25 and outlet end 26. As would be well known to the routineer in the burner art, the venturi tube 22 may generally be circular in cross-sectional configuration, and the outlet end 26 thereof should preferably and generally be larger in diameter than either the inlet end 25 or the throat 24.

As illustrated in FIG. 1, outlet end 26 of venturi tube 22 is preferably positioned within and surrounded by entrance 18. Additionally, the outer periphery 28 of outlet end 26 is smaller in diameter than the annular inner edge surface 30 of entrance 18. Thus, an annular gap 32 is presented between the outer periphery 28 of the outlet end 26 of the venturi tube 22 and the inner edge surface 30. An annular shroud 33 is positioned within entrance 18 and is mounted on edge surface 30 so as to provide a mouth 35 for the gap 32.

The burner assembly 10 is also provided with a swirler 34 which is positioned centrally within the outlet end 28 of the venturi tube 22. As can be clearly seen in FIG. 1, the outer diameter of the swirler 34 is smaller than the internal diameter of the venturi tube 22 at the outlet end 28 of the latter. This provides an annular space 36 which surrounds the swirler 34 within the venturi tube 22.

The burner assembly 10 of the invention also may preferably be provided with a conventional ignitor 38 and one or more central fuel gas nozzles 40. Only a single nozzle is shown in FIG. 1; however, one of ordinary skill in the burner art would understand that the burner 10 may include a plurality of central fuel gas nozzles spaced evenly around the longitudinal axis of the venturi tube 22. The determinative factor in choosing the number of central fuel gas nozzles to use is simply to make sure that the central or primary gas flow is evenly distributed in the combustion air. The nozzle or nozzles 40, as the case may be, provide fuel gas to the air flowing through the center of the venturi tube 22. The burner assembly 10 may also preferably be equipped with a conventional steam operated fuel oil atomizer unit 42 so that the burner 10 is adapted to burn fuel oil as well as gaseous fuels including natural gas.

Figure 2:
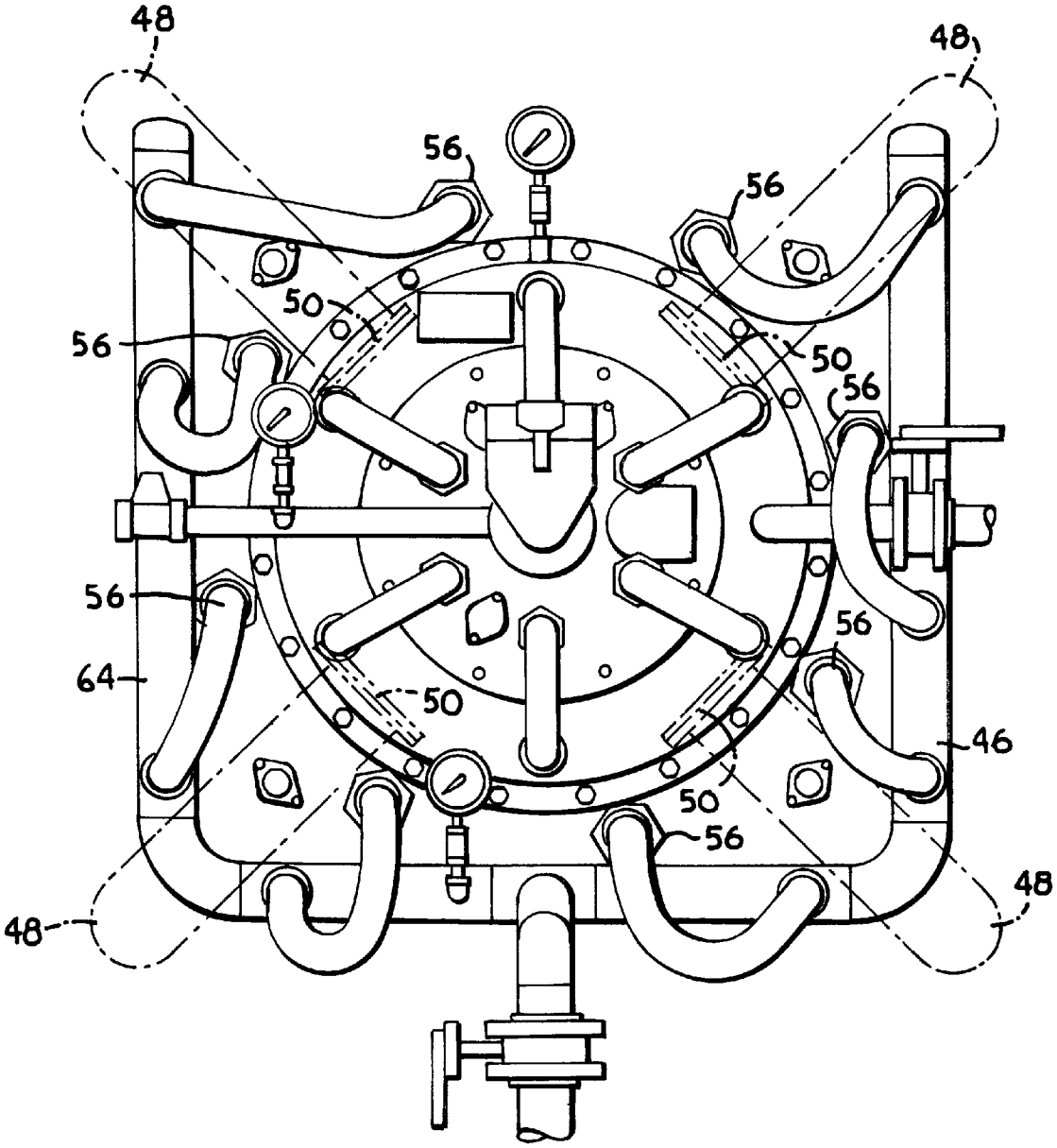
FIG. 2 is a front end elevational view of the burner of FIG. 1.

In accordance with the concepts and principles of the invention, the burner assembly includes at least one fuel gas poker 44 for delivering fuel gas to the air traveling through the venturi tube 22 on its way to the combustion zone 14. Although only a single poker 44 is shown in FIG. 1, the burner assembly 10 may preferably include three or more fuel gas pokers 44 spaced evenly around the inside of the venturi tube 22. Conventionally the burner may include six to eight pokers 44 as illustrated in FIG. 2; however, if the invention of the '803 patent is employed, the burner 10 may need only three pokers 44. The pokers 44 may each include an elongated tube 45 and a nozzle 47, and the same may conventionally be linked together by a fuel gas manifold 46 as shown in FIG.2. The principal design consideration in selecting the correct number of pokers for any given installation is that the fuel gas be distributed evenly around the entire circumference of the venturi tube 22.

Desirably burner assembly 10 of the invention may include one or more ducts 48 for internal recirculating flue gas 49 from a point within the combustion chamber 16 adjacent combustion zone 14 to the air flowing through venturi tube 22 at the low pressure zone 72 in throat 24 thereof. A single duct 48 is shown in FIG. 1 for illustrative purposes. However, burner assembly 10 preferably may include four ducts 48 spaced 90 degrees apart around the periphery of the venturi tube 22 as best shown in FIG. 2. Again, the principal design consideration in selecting the correct number of ducts 48 for a given application is simply that the recirculated flue gas be distributed evenly around the entire circumference of the venturi tube. Ducts 48 may each be provided with an outlet 50 which is connected to the venturi tube at a point adjacent to the low pressure zone 72 at the throat 24 of the venturi tube 22 so that recirculated flue gas 49 is inducted into the venturi tube 22. Each duct 48 also preferably has an inlet 52 which is in fluid communication with the interior of the combustion chamber via an opening 54 in wall 20. Thus, flue gas 49 from adjacent the combustion zone 14 in chamber 16 may be inducted into the air flowing through the venturi tube 22 and intermixed therewith at throat 24.

As is illustrated in FIG. 1, the burner 10 of the invention may also be provided with at least one external fuel gas injector 56. The injector 56 may preferably include an elongated tube 58 and a nozzle 60. The nozzle 60 protrudes through an opening 62 which extends through wall 20 such that the nozzle 60 is positioned in outwardly spaced relationship relative to entrance 18. That is to say, opening 62 is positioned outwardly beyond the inner edge surface 30 of entrance 18 and therefore the nozzle 60 is positioned to direct a flow of fuel gas into said combustion chamber 16 at a location adjacent to and externally of the combustion air flowing into combustion zone 14.

A single fuel gas injector 56 is shown in FIG. 1 for illustrative purposes. However, as shown in FIG. 2, the burner assembly 10 may preferably include four to eight fuel gas injectors 56 spaced 45 degrees apart around the periphery of the venturi tube 22. Again, the principal design consideration in selecting the correct number of fuel gas injectors 56 for a given application is that the fuel gas be distributed evenly around the entire periphery of the combustion zone 14. The injectors 56 are provided with a manifold 64 which distributes fuel gas thereto.

In operation, combustion air enters the burner 10 from windbox 12 and is divided into three separate and distinct portions. The flow path of primary air is designated by the arrow 66, the flow path of secondary air is designated by the arrow 68 and the flow path of tertiary air is designated by the arrow 70. As dictated by the shape and size of the venturi tube 22, the shape and configuration of the swirler 34 and the shape and size of the entrance 18, primary air 66 moves to the center of the venturi tube 22 where it is mixed with fuel gas from the centrally located fuel nozzle 40 and caused to flow through the swirler 34 which rotates the primary air/central fuel gas mixture in a manner well known to the routineer in the burner art. Thus, primary air 66 and central fuel gas from nozzle 40 are thoroughly mixed and agitated as the same are directed into the center core of the combustion zone 14.

Secondary air 68 moves in a generally straight line through the venturi tube 22 and passes into the combustion zone. As the secondary air 68 passes around the swirler 34, it is in the shape of an annular envelope that surrounds the swirler 34 and the swirled primary air 66. As can be seen viewing FIG. 1, the fuel gas pokers 44 are positioned radially outwardly relative to the swirler 34 and such that the fuel gas from the poker nozzles 47 is intermixed with the secondary air 68. Thus, straight line secondary air 68 and the fuel gas from poker nozzles 47 are directed in a straight line into the combustion zone 14 at a position which is radially outward of the center of the latter.

Tertiary air 70 moves in a straight line around the periphery of the venturi tube 22 and is guided by the mouth 35 so that it passes through the gap 32 between the outlet end 26 of the venturi tube 22 and the inner edge surface 30 of the entrance 18. The tertiary air 70 is in the shape of an annulus which surrounds the venturi tube 22 and the secondary air 68 as it is introduced into the combustion zone 14.

Fuel gas from the injectors 56 is introduced into the combustion chamber 16 at a position which is radially outward relative to the center of the combustion zone 14 and to the primary, secondary and tertiary air flows 66, 68 and 70.

Generally speaking, the outlet end of the venturi tube 22 may preferably be about 6 to about 40 inches in diameter. The shape of the venturi tube 22 is not necessarily critical to the operation of the burner 10. That is to say, the shape of the venturi tube is in some measure dictated by the desired air flow rate characteristics. However, it has been determined experimentally that the venturi tube 22 may preferably be shaped such that the ratio of the diameter of the throat 24 to the diameter of the outlet end 26 may preferably be in the range of from about 1:1.2 to about 1:1.6. It has also been determined experimentally that the ratio of the total cross-sectional area of the annular gap 32 to the total cross-sectional area of the outlet end 26 of the venturi tube 22 may preferably, but not necessarily, be in the range of from about 1:6 to about 1:8. It is also preferred, but not necessarily required, that the swirler 34 be positioned at a distance from the outlet end 26 which is within the range of from about 0.4 to about 0.6 times the internal diameter of outlet end 26.

Figure 3:
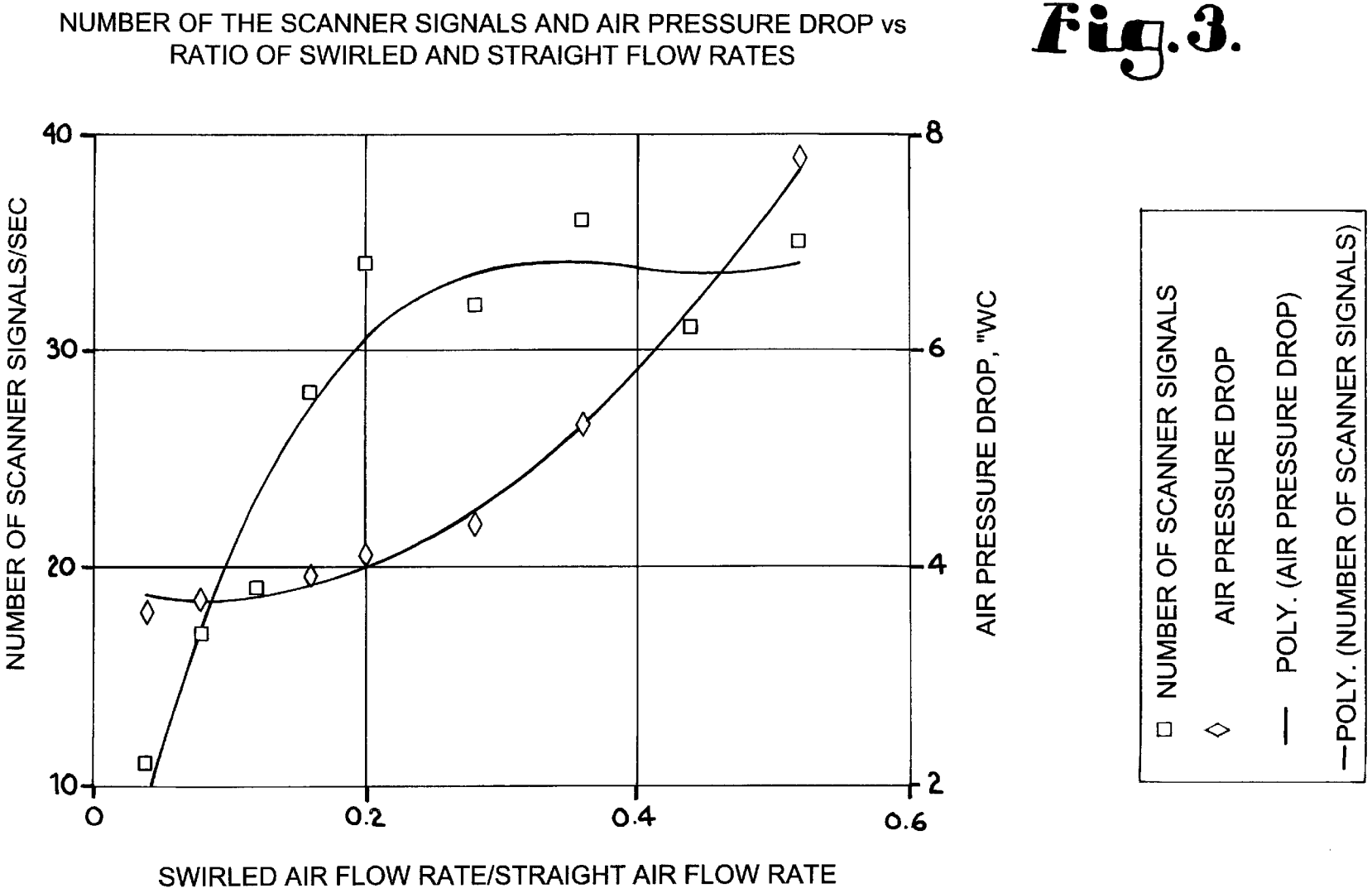
FIG. 3 is a graph illustrating the number of scanner signals and the air pressure drop data obtained in a combustion chamber burner of the invention as the ratio of swirled air flow to straight air flow is changed.

The difference between the forward velocity of the swirled primary air stream 66 and the forward velocity of the straight line secondary air stream 68 is associated with the physical design of the burner. Conceptually, all of the primary air stream 66 passes through the swirler 34. On the other hand, the secondary stream 68 passes around the swirler 34 and theoretically none of it passes through the swirler 34. Clearly none of the tertiary air flow 70 passes through the swirler 34. The swirler 34 imposes a degree of aerodynamic resistance on the primary stream 66 passing therethrough. Thus, the velocities of the straight line streams 68 and 70 are greater than the velocity of the primary stream 66. As can be seen from FIG. 3, when the ratio of swirled primary air flow to straight line air flow (secondary+tertiary) is greater than about 0.2, air resistance increase rapidly. On the other hand, when the ratio of swirled primary air flow to straight line air flow is less than about 0.08, flame stability problems occur. From these parameters, the preferred relative air flow velocities may be determined. Thus, in actual operation, it is preferred that the ratio of the forward velocity of the primary swirled air stream 66 to the forward velocities of the straight line air streams 68 and 70 should be in the range of from about 1:1.1 to about 1:1.5.

Figure 4:
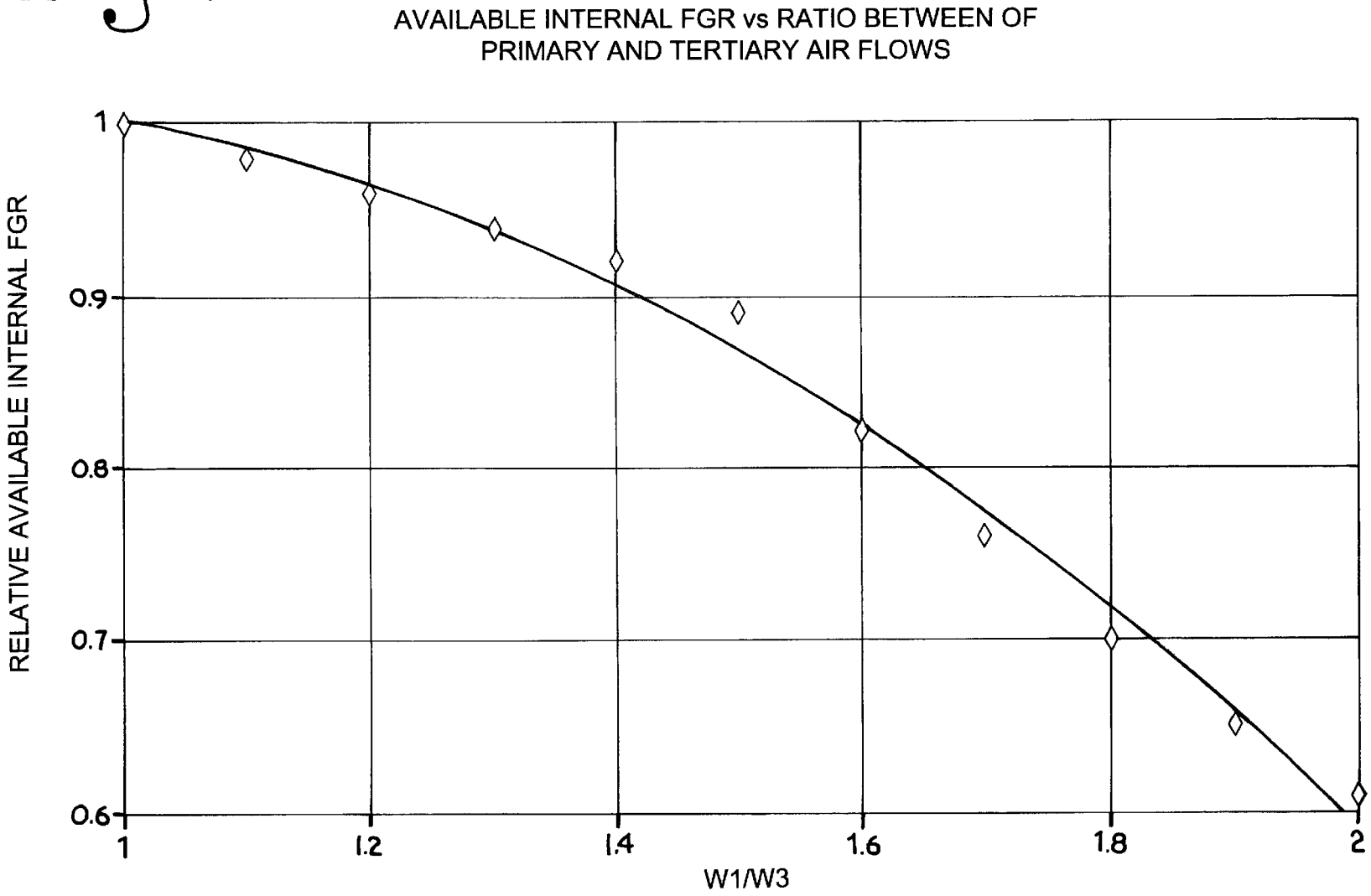
FIG. 4 is a graph illustrating the amount of the relative available internal flue gas recirculation flow measured when the ratio of primary and tertiary air flows is changed.
Figure 7:
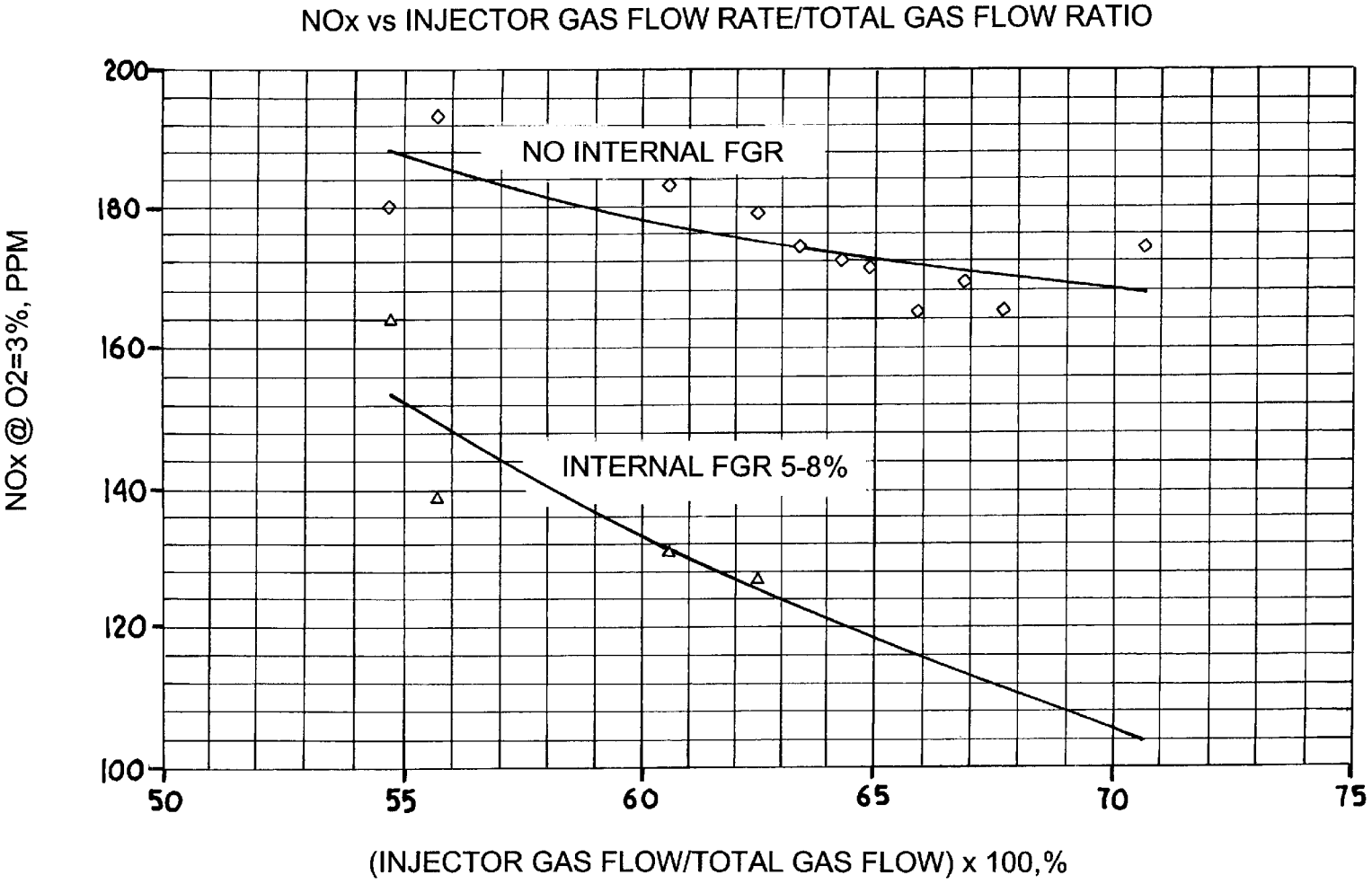
FIG. 7 is a graph illustrating the improved performance of the burner of the invention in terms of achieving reduction of $NO_x$ emissions when internal flue gas is recirculated.

As set forth above, the preferred lower limit of the tertiary air flow velocity is about 1.1 times the primary air velocity. In accordance with FIG. 4, an increase in the velocity of the tertiary air velocity is accompanied by a decrease in the amount of recirculated flue gas 49 which can be induced into the combustion air by the venturi effect at low pressure zone 72 in venturi tube 22. There is a comparatively small influence on the amount of flue gas recirculated by induction when the ratio of the velocities of the tertiary and primary air streams is 1.5 or less. However, when this ratio exceeds 1.5, the recirculated flue gas rate drops off quickly. This phenomena also supports the preference for a primary air velocity to tertiary air velocity ratio of 1.5 or less. In accordance with the invention, the recirculated internal flue gas rate should preferably be within the range of from about 4% to about 8%, inclusive, based on the total amount of combustion air supplied to the burner. The effectiveness of such recirculation is apparent from FIG. 7.

The center core of the burner flame is located in the central part of the combustion zone 14. This part of the flame, which is fed primarily by the primary air flow and the fuel from the central fuel nozzles 40, is responsible for stability and vibration of the entire flame. In addition, the core of the flame plays a role as a flame pilot whenever the heat load is reduced to a minimum. It is well known to the routineer in the burner art that the most stable flame occurs when the conditions in the burner are stoichiometric. From a practical viewpoint, however, flames are sufficiently stable whenever the amount of air is at least 70% of the amount that is theoretically sufficient to burn all of the fuel and no greater than 110% of such amount. Thus, the fuel/air ratio in the primary air stream should be maintained such that the available oxygen ranges from about 70% to about 110% of theoretical at the time the primary air stream enters the combustion zone.

Figure 5:
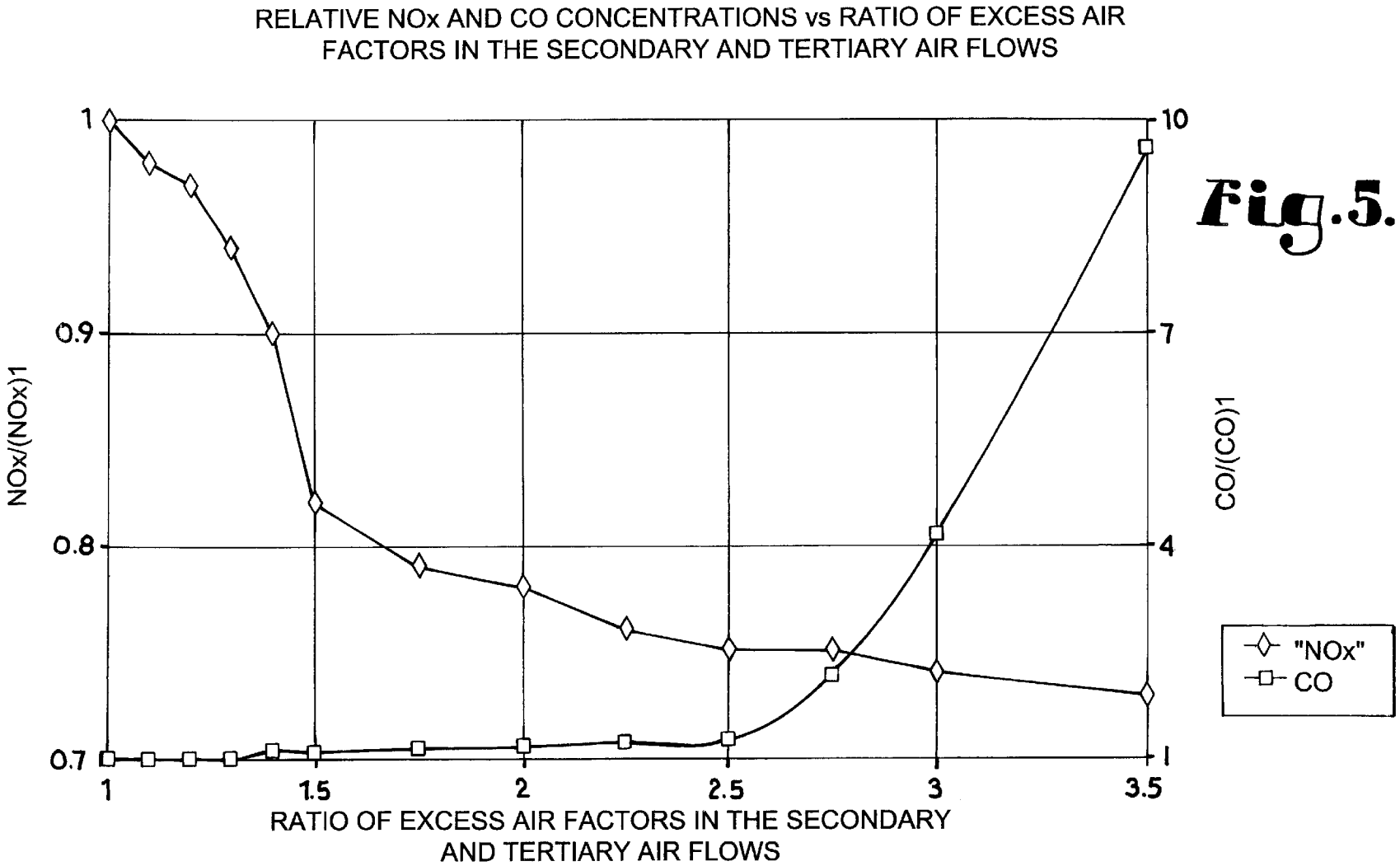
FIG. 5 is a graph illustrating the improved performance of the burner of the invention in terms of achieving reduction of CO and $NO_x$ emissions as the ratio between excess air factors in the secondary and tertiary air flows is varied.

As can be seen from FIG. 5, however, there is an effective reduction in emitted $NO_x$ without a corresponding increase in emitted CO when the ratio of the excess air factor in the secondary stream 68 to the excess air factor in the tertiary air stream 70 is in the range of from about 1.3:1 to about 2.7:1. When this ratio is less than about 1.3:1, $NO_x$ reduction is negligible. When this ratio is above about 2.7, CO emission becomes unacceptable. Coupled with the foregoing information, one must take into consideration the fact that the state of the art knowledge is that the local excess air factor should preferably never be more than 2.0 to prevent local cooling of the flame, and should preferably never be less than about 0.7 to avoid the unacceptable concentrations of incompletely combusted products in the flue gas. Based on these considerations, and in accordance with the concepts and principles of the present invention, it has been determined that the excess air factor provided by the primary stream 66 should preferably be in the range of from about 0.7 to about 1.1, that the excess air factor provided by the secondary stream 68 should preferably be in the range of from about 0.7 to about 2, and that the excess air factor provided by the tertiary stream 70 should preferably be in the range of from about 0.5 to about 0.7.

With reference to the foregoing considerations the preferred relative primary fuel gas flow can be determined. Thus, the primary fuel gas flow is a multiplication product of the relative primary air flow and the primary excess air factor, which is (0.08–0.20)×(0.7–1.1)=(0.056–0.22). It is known that in order to avoid stability and vibration problems when the heat load is reduced, such reduction should be accompanied by an increase in the proportion of the fuel gas fed to the core of the flame. Usually, under full load conditions, the amount of fuel fed to the core of the flame should be about 6% of the total fuel flow rate. Tests have shown that the amount of fuel gas fed to the center of the flame should be increased at a rate which is about the fourth degree root of the burner turndown. Thus, to accommodate a standard turndown of 12.5:1, the fuel fed to the core of the flame should amount to $6^{-4}\times12.5=19.6\%$ of the total fuel rate. So the amount of the total fuel in the primary air stream 66 should preferably range from about 6% to about 19%. These numbers are comparatively close to the numbers calculated above.

Figure 6:
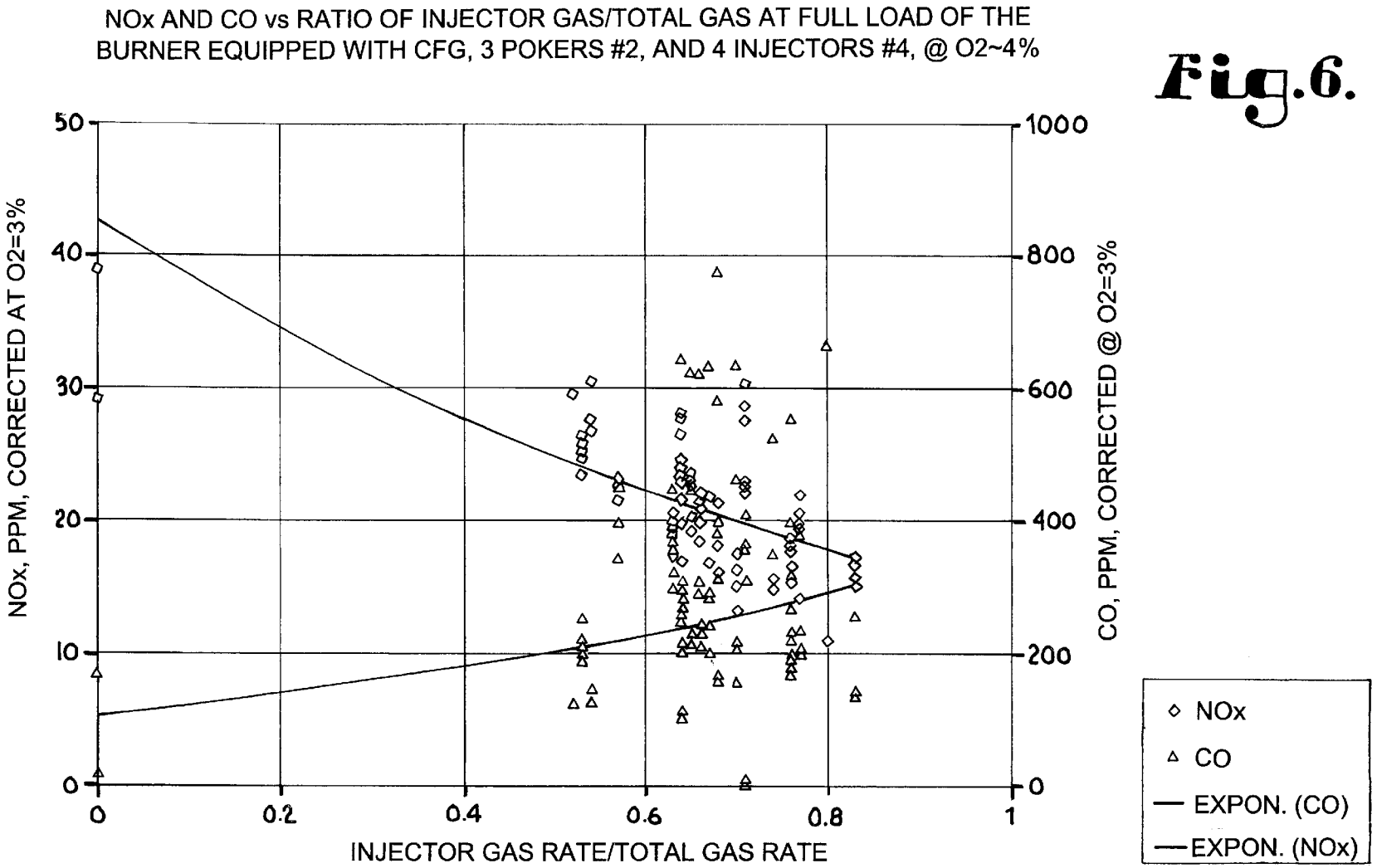
FIG. 6 is a graph illustrating the improved performance of the burner of the invention in terms of achieving reduction of CO and $NO_x$ emissions as the injector fuel gas flow rate is varied with respect to the total fuel gas flow rate.

With reference to FIG. 6, it can be seen that a desirable degree of $NO_x$ reduction is achieved without an unacceptable increase in CO emissions when the ratio of the fuel gas rate from the injector nozzles 60 ranges from about 65% to about 85% of the total fuel rate. Thus, under full load, the secondary fuel gas flow from the poker nozzles 47 should preferably range from about 9% to about 29% of the total fuel gas flow. Under partial loads, the secondary fuel gas flow from the poker nozzles 47 should preferably be a little less than about 5% of the total fuel gas flow. So the overall secondary fuel gas flow rate from the poker nozzles 47 should preferably range from about 5% to about 29% of the total fuel gas flow.

In sum, and in accordance with the concepts and principles of the present invention, it has been determined that the flow rate of the primary fuel gas from nozzles 40 should preferably be in the range of from about 6% to about 19% of the total fuel supplied to the burner, that the flow rate of the secondary fuel fed from poker nozzles 47 should preferably be in the range of from about 5% to about 29% of the total fuel supplied to the burner, and that the flow rate of the tertiary fuel supplied from nozzles 60 should preferably be in the range of from about 52% to about 89% of the total fuel supplied to the burner.

It has also been determined in accordance with the principles and concepts of the invention, that the ratio of recirculated internal flue gas 49 to total combustion air flow (66, 68 and 70) should preferably be in the range of from about 0.04:1 to about 0.08:1. This factor is determined by a balance between flame stability and emission reduction and is controlled by the various flow rates of the combustion air as discussed above.

We claim:

1. A round burner capable of reduced CO and $NO_x$ emissions comprising:

a venturi tube for directing a flow of air through the burner and into a combustion zone in a combustion chamber through an entrance in a wall of the combustion chamber, said venturi tube having an inlet end, an outlet end and a throat having a lesser internal diameter than either of said ends located between said ends, said throat being operable when said flow of air passes through the venturi tube to create a low pressure zone therein, said venturi tube being positioned with its outlet end located adjacent said entrance to the combustion chamber, said venturi tube including a flue gas inlet connection located adjacent said throat for introducing recirculated flue gas directly into said low pressure zone;

a swirler positioned in the venturi tube such that a primary portion of said flow of air passes therethrough, the arrangement of the outlet end of the venturi tube and the swirler being such that a secondary portion of said flow of air does not pass through the swirler; and a duct system including at least one inlet disposed in fluid communication with the combustion zone and at least one outlet connected to the flue gas inlet connection of the venturi tube, said system being arranged and adapted to recirculate a stream of flue gas from a location in said combustion chamber adjacent said combustion zone and into said flue gas inlet connection, whereby said stream of flue gas is inducted into said low pressure zone through said flue gas inlet connection and intermixed in the low pressure zone with said flow of air.

2. A round burner as set forth in claim 1, wherein said burner includes at least one first fuel gas nozzle located in said venturi tube and positioned to introduce a supply of fuel gas into said flow of air.

3. A round burner as set forth in claim 1, wherein said venturi tube has an outer periphery and said entrance has an inner annular edge, said periphery and said inner edge defining an annular gap therebetween, said gap being positioned to direct a tertiary air flow around the periphery of the venturi tube and through the entrance into said combustion chamber.

4. A round burner as set forth in claim 2, wherein said venturi tube has an outer periphery and said entrance has an inner annular edge, said periphery and said inner edge defining an annular gap therebetween, said gap being positioned to direct a tertiary air flow around the periphery of the venturi tube and through the entrance into said combustion chamber.

5. A round burner as set forth in claim 4, wherein said at least one first fuel gas nozzle is positioned centrally of the venturi tube adjacent a longitudinal axis thereof and at a location to introduce fuel gas into said primary portion of the flow of air, and said burner includes at least one fuel gas poker nozzle positioned to introduce fuel gas into said secondary portion of the flow of air.

6. A round burner as set forth in claim 1, wherein said burner is adapted for burning fuel oil introduced into said venturi tube.

7. A round burner as set forth in claim 1, wherein said burner is adapted for burning natural gas.

8. A round burner as set forth in claim 6, wherein said burner is adapted for burning natural gas.

9. A round burner capable of reduced CO and $NO_x$ emissions comprising:

a venturi tube for directing a flow of air through the burner and into a combustion zone in a combustion chamber through an entrance in a wall of the combustion chamber, said venturi tube having an inlet end, an outlet end and a throat having a lesser internal diameter than either of said ends located between said ends, said throat being operable when said flow of air passes through the venturi tube to create a low pressure zone therein, said venturi tube being positioned with its outlet end located adjacent said entrance to the combustion chamber, said venturi tube including a flue gas inlet connection located adjacent said throat for introducing recirculated flue gas directly into said low pressure zone, said venturi tube further having an outer periphery and said entrance having an inner annular edge, said periphery and said inner edge defining an annular gap therebetween, said gap being positioned to direct a tertiary air flow around the periphery of the venturi tube and through the entrance into said combustion chamber; and a duct system including at least one inlet disposed in fluid communication with the combustion zone and at least one outlet connected to the flue gas inlet connection of the venturi tube, said system being arranged and adapted to recirculate a stream of flue gas from a location in said combustion chamber adjacent said combustion zone and into said flue gas inlet connection, whereby said stream of flue gas is inducted into said low pressure zone through said flue gas inlet connection and intermixed in the low pressure zone with said flow of air.

10. A round burner as set forth in claim 9, wherein said burner includes a swirler positioned so that at least a primary portion of said flow of air passes therethrough.

11. A round burner as set forth in claim 10, wherein the arrangement of the outlet end of the venturi tube and the swirler is such that a secondary portion of said flow of air does not pass through the swirler.

12. A round burner as set forth in claim 9, wherein said at least one first fuel gas nozzle is positioned centrally of the venturi tube adjacent a longitudinal axis thereof and at a location to introduce fuel gas into said primary portion of the flow of air, and said burner includes at least one fuel gas poker nozzle positioned to introduce fuel gas into said secondary portion of the flow of air.

13. A round burner as set forth in claim 9, wherein said burner includes at least one gas nozzle located in said venturi tube and positioned to introduce a supply of fuel gas into said flow of air.

14. A round burner as set forth in claim 9, wherein said burner is adapted for burning fuel oil introduced into said venturi tube.

15. A round burner as set forth in claim 9, wherein said burner is adapted for burning natural gas.

16. A round burner as set forth in claim 14, wherein said burner is adapted for burning natural gas.

17. A round burner capable of reduced CO and $NO_x$ emissions comprising:

a venturi tube positioned to direct a flow of air through the burner and into a combustion zone in a combustion chamber through an entrance in a wall of the combustion chamber, said venturi tube having an outer periphery and inlet and outlet ends, said outlet end of the venturi tube having a larger internal diameter than said inlet end, said outlet end of the venturi tube being positioned adjacent said entrance to the combustion chamber, said inlet end of the venturi tube being positioned further from said entrance than said outlet end of the venturi tube, said entrance having an inner edge;

a fuel gas injector arrangement including at least one injector nozzle extending through said wall at a location adjacent said combustion zone, said nozzle being in fluid communication with said combustion chamber and positioned to direct a flow of fuel gas into said combustion chamber at a location in the wall beyond said inner edge of the entrance; and a swirler positioned so that at least a primary portion of said flow of air passes therethrough, wherein the arrangement of the outlet end of the venturi tube and the swirler is such that a secondary portion of said flow of air does not pass through the swirler.

18. A round burner as set forth in claim 17 wherein is included at least one first fuel gas nozzle located in said venturi and positioned to introduce a supply of fuel gas into said flow of air.

19. A round burner capable of reduced CO and $NO_x$ emissions comprising:

a venturi tube positioned to direct a flow of air through the burner and into a combustion zone in a combustion chamber through an entrance in a wall of the combustion chamber, said venturi tube having an outer periphery and inlet and outlet ends, said outlet end of the venturi tube having a larger internal diameter than said inlet end, said outlet end of the venturi tube being positioned adjacent said entrance to the combustion chamber, said inlet end of the venturi tube being positioned further from said entrance than said outlet end of the venturi tube, said entrance having an inner edge;

a fuel gas injector arrangement including at least one injector nozzle extending through said wall at a location adjacent said combustion zone, said nozzle being in fluid communication with said combustion chamber and positioned to direct a flow of fuel gas into said combustion chamber at a location in the wall beyond said inner edge of the entrance; and a swirler positioned so that at least a primary portion of said flow of air passes therethrough, wherein the arrangement is such that an annular gap is provided between said outer periphery at the outlet end of the venturi tube and said inner edge, said gap is positioned to direct a tertiary air flow around the periphery of the venturi tube and through the entrance into said combustion chamber, and said injector nozzle is positioned radially outside said gap.

20. A round burner as set forth in claim 17, wherein an annular gap is provided between said outer periphery at the outlet end of the venturi tube and said inner edge, said gap being positioned to direct a tertiary air flow around the periphery of the venturi tube and through the entrance into said combustion chamber, said injector nozzle being positioned radially outside said gap.

21. A round burner as set forth in claim 18, wherein is included at least one first fuel gas nozzle located in said venturi and positioned to introduce a supply of fuel gas into said flow of air.

22. A round burner as set forth in claim 18, wherein an annular gap is provided between said outer periphery at the outlet end of the venturi tube and said inner edge, said gap being positioned to direct a tertiary air flow around the periphery of the venturi tube and through the entrance into said combustion chamber, said injector nozzle being positioned radially outside said gap.

23. A round burner as set forth in claim 18, wherein said at least one first fuel gas nozzle is positioned centrally of the venturi tube adjacent a longitudinal axis thereof and at a location to introduce fuel gas into said primary portion of the flow of air, and said burner includes at least one fuel gas poker nozzle positioned to introduce fuel gas into said secondary portion of the flow of air.

24. A round burner as set forth in claim 22, wherein said at least one first fuel gas nozzle is positioned centrally of the venturi tube adjacent a longitudinal axis thereof and at a location to introduce fuel gas into said primary portion of the flow of air, and said burner includes at least one fuel gas poker nozzle positioned to introduce fuel gas into said secondary portion of the flow of air.

25. A round burner capable of reduced CO and $NO_x$ emissions comprising:

a venturi tube for directing a flow of air through the burner and into a combustion zone in a combustion chamber through an entrance in a wall of the combustion chamber, said venturi tube having an inlet end, an outlet end and a throat having a lesser internal diameter than either of said ends located between said ends, said throat being operable when said flow of air passes through the venturi tube to create a low pressure zone therein, said venturi tube being positioned with its outlet end located adjacent said entrance to the combustion chamber, said venturi tube including a flue gas inlet connection located adjacent said throat for introducing recirculated flue gas directly into said low pressure zone, said tube further having an outer periphery and said entrance having an inner edge;

a fuel gas injector arrangement including an injector nozzle extending through said wall at a location adjacent said combustion zone, said nozzle being in fluid communication with said combustion chamber and positioned to direct a flow of fuel gas into said combustion chamber at a location in the wall beyond said inner edge of the entrance;

a duct system including at least one inlet disposed in fluid communication with the combustion zone and at least one outlet connected to the flue gas inlet connection of the venturi tube, said system being arranged and adapted to recirculate a stream of flue gas from a location in said combustion chamber adjacent said combustion zone and into said flue gas inlet connection, whereby said stream of flue gas is inducted into said low pressure zone through said flue gas inlet connection and intermixed in the low pressure zone with said flow of air; and a swirler positioned so that at least a primary portion of said flow of air passes therethrough, wherein the arrangement of the outlet end of the venturi tube and the swirler is such that a secondary portion of said flow of air does not pass through the swirler.

26. A round burner as set forth in claim 27 wherein is included at least one first fuel gas nozzle located in said venturi tube and positioned to introduce a supply of fuel gas into said flow of air.

27. A round burner as set forth in claim 25, wherein an annular gap is provided between said outer periphery at the outlet end of the venturi tube and said inner edge, said gap being positioned to direct a tertiary air flow around the periphery of the venturi tube and through the entrance into said combustion chamber, said injector nozzle being positioned radially outside said gap.

28. A round burner as set forth in claim 25, wherein an annular gap is provided between said outer periphery at the outlet end of the venturi tube and said inner edge, said gap being positioned to direct a tertiary air flow around the periphery of the venturi tube and through the entrance into said combustion chamber, said injector nozzle being positioned radially outside said gap.

29. A round burner as set forth in claim 26, wherein said at least one first fuel gas nozzle is positioned centrally of the venturi tube adjacent a longitudinal axis thereof and at a location to introduce fuel gas into said primary portion of the flow of air, and said burner includes at least one fuel gas poker nozzle positioned to introduce fuel gas into said secondary portion of the flow of air.

30. A round burner as set forth in claim 28, wherein said at least one first fuel gas nozzle is positioned centrally of the venturi tube adjacent a longitudinal axis thereof and at a location to introduce fuel gas into said primary portion of the flow of air, and said burner includes at least one fuel gas poker nozzle positioned to introduce fuel gas into said secondary portion of the flow of air.

31. A method for operating a venturi tube equipped round burner so as to achieve reduced CO and $NO_x$ emissions, said venturi tube having an inlet end, an outlet end and a throat disposed between said ends, said throat having a lesser internal diameter than either of said ends and being operable when a flow of fluid passes through the venturi tube to create a low pressure zone therein, said venturi tube including a flue gas inlet connection located adjacent said throat to permit induction of recirculated flue gas directly into said low pressure zone, said venturi tube being positioned with its outlet end located adjacent an entrance to a combustion chamber, said burner having a swirler located in said tube, said method comprising:

directing a flow of air through said venturi tube and into a combustion zone in said combustion chamber through said entrance to thereby create a low pressure zone in said venturi tube adjacent said flue gas inlet connection, said directing being conducted so that a primary portion of the air flowing through the venturi tube passes through said swirler and a secondary portion of the air flowing through the venturi tube does not pass through the swirler; and using the low pressure in said low pressure zone to induce a recirculation of flue gas from a location in said combustion chamber adjacent said combustion zone, through the flue gas inlet connection and directly into said low pressure zone, whereby recirculated flue gas is intermixed with said flow of air in said low pressure zone.

32. A method for operating a venturi tube equipped round burner as set forth in claim 31, wherein is included a step of introducing a first supply of fuel gas into said flow of air.

33. A round burner capable of reduced CO and $NO_x$ emissions comprising:

a venturi tube for directing a flow of air through the burner and into a combustion zone in a combustion chamber through an entrance in a wall of the combustion chamber, said venturi tube having an inlet end, an outlet end and a throat having a lesser internal diameter than either of said ends located between said ends, said throat being operable when said flow of air passes through the venturi tube to create a low pressure zone therein, said venturi tube being positioned with its outlet end located adjacent said entrance to the combustion chamber, said venturi tube including a flue gas inlet connection located adjacent said throat for introducing recirculated flue gas directly into said low pressure zone, said tube further having an outer periphery and said entrance having an inner edge;

a fuel gas injector arrangement including an injector nozzle extending through said wall at a location adjacent said combustion zone, said nozzle being in fluid communication with said combustion chamber and positioned to direct a flow of fuel gas into said combustion chamber at a location in the wall beyond said inner edge of the entrance;

a duct system including at least one inlet disposed in fluid communication with the combustion zone and at least one outlet connected to the flue gas inlet connection of the venturi tube, said system being arranged and adapted to recirculate a stream of flue gas from a location in said combustion chamber adjacent said combustion zone and into said flue gas inlet connection, whereby said stream of flue gas is inducted into said low pressure zone through said flue gas inlet connection and intermixed in the low pressure zone with said flow of air; and a swirler positioned so that at least a primary portion of said flow of air passes therethrough, wherein the arrangement is such that an annular gap is provided between said outer periphery at the outlet end of the venturi tube and said inner edge, said gap is positioned to direct a tertiary air flow around the periphery of the venturi tube and through the entrance into said combustion chamber, and said injector nozzle is positioned radially outside said gap.

34. A round burner as set forth in claim 33 wherein is included at least one first fuel gas nozzle located in said venturi tube and positioned to introduce a supply of fuel gas into said flow of air.

35. A method for operating a venturi tube equipped round burner as set forth in claim 31, wherein said venturi tube has an outer periphery and an annular gap is provided between said outer periphery at the outlet end of the venturi tube and an inner edge of said entrance, said method including a step of causing a tertiary air stream to flow around the periphery of the venturi tube, through the gap, and into said combustion chamber.

36. A method for operating a venturi tube equipped round burner as set forth in claim 32, wherein said venturi tube has an outer periphery and an annular gap is provided between said outer periphery at the outlet end of the venturi tube and an inner edge of said entrance, said method including a step of causing a tertiary air stream to flow around the periphery of the venturi tube, through the gap, and into said combustion chamber.

37. A method for operating a venturi tube equipped round burner as set forth in claim 35, wherein said first supply of fuel gas is introduced into said primary portion of the flow of air, and a second separate supply of fuel gas is introduced into said secondary portion of the flow of air.

38. A method for operating a venturi tube equipped round burner as set forth in claim 31, wherein a supply of fuel oil is introduced into said flow of air.

39. A method for operating a venturi tube equipped round burner so as to achieve reduced CO and $NO_x$ emissions said venturi tube having an inlet end, an outlet end and a throat disposed between said ends, said throat having a lesser internal diameter than either of said ends and being operable when a flow of fluid passes through the venturi tube to create a low pressure zone therein, said venturi tube including a flue gas inlet connection located adjacent said throat to permit induction of recirculated flue gas directly into said low pressure zone, said venturi tube being positioned with its outlet end located adjacent an entrance to a combustion chamber, said venturi tube further having an outer periphery and being positioned such that an annular gap is provided between said outer periphery at the outlet end of the venturi tube and an inner edge of said entrance, said method comprising:

directing a flow of air through said venturi tube and into a combustion zone in said combustion chamber through said entrance to thereby create a low pressure zone in said venturi tube adjacent said flue gas inlet connection;

causing a tertiary air stream to flow around the periphery of the venturi tube, through the gap, and into said combustion chamber; and using the low pressure in said low pressure zone to induce a recirculation of flue gas from a location in said combustion chamber adjacent said combustion zone, through the flue gas inlet connection and directly into said low pressure zone, whereby recirculated flue gas is intermixed with said flow of air in said low pressure zone.

40. A method for operating a venturi tube equipped round burner as set forth in claim 32, wherein is included a step of passing at least a primary portion of said flow of air through a swirler.

41. A method for operating a venturi tube equipped round burner as set forth in claim 40, wherein a secondary portion of said flow of air does not pass through the swirler.

42. A method for operating a venturi tube equipped round burner as set forth in claim 39, wherein is included a step of introducing a supply of fuel gas into said flow of air.

43. A method for operating a venturi tube equipped round burner as set forth in claim 39, wherein is included a step of introducing a supply of fuel oil into said flow of air.

44. A method for operating a venturi tube equipped round burner with reduced CO and $NO_x$ emissions, said method comprising:

directing a flow of air through the venturi tube and into a combustion zone in a combustion chamber through an entrance in a wall of the combustion chamber, said entrance having an inner edge;

injecting a flow of fuel gas into said combustion chamber at a location radially beyond said inner edge of the entrance and adjacent said combustion zone; and passing at least a primary portion of said flow of air through a swirler, wherein a secondary portion of said flow of air does not pass through the swirler.

45. A method for operating a venturi tube equipped round burner as set forth in claim 44, comprising introducing a first supply of fuel gas into said flow of air.

46. A method for operating a venturi tube equipped round burner as set forth in claim 44, wherein said venturi tube has an outer periphery and an annular gap is provided between said outer periphery at the outlet end of the venturi tube and said inner edge of said entrance, said method including a step of causing a tertiary air stream to flow around the periphery of the venturi tube, through the gap, and into said combustion chamber.

47. A method for operating a venturi tube equipped round burner as set forth in claim 45, wherein said venture tube has an outer periphery and an annular gap is provided between said outer periphery at the outlet end of the venturi tube and said inner edge of said entrance, said method including a step of causing a tertiary air stream to flow around the periphery of the venturi tube, through the gap, and into said combustion chamber.

48. A method for operating a venturi tube equipped round burner as set forth in claim 45, wherein said first supply of fuel gas is introduced into said primary portion of the flow of air, and a second separate supply of fuel gas is introduced into said secondary portion of the flow of air.

49. A method for operating a venturi tube equipped round burner as set forth in claim 47, wherein said first supply of fuel gas is introduced into said primary portion of the flow of air, and a second separate supply of fuel gas is introduced into said secondary portion of the flow of air.

50. A method for operating a venturi tube equipped round burner with reduced CO and $NO_x$ emissions, said method comprising:

directing a flow of air through the venturi tube and into a combustion zone in a combustion chamber through an entrance in a wall of the combustion chamber, wherein said entrance has an inner edge, said venturi tube has an outer periphery, and an annular gap is provided between said outer periphery at the outlet end of the venturi tube and said inner edge of said entrance;

injecting a flow of fuel gas into said combustion chamber at a location radially beyond said inner edge of the entrance and adjacent said combustion zone;

passing at least a primary portion of said flow of air through a swirler; and causing a tertiary air stream to flow around the periphery of the venturi tube, through the gap, and into said combustion chamber.

51. A method for operating a venturi tube equipped round burner as set forth in claim 50, wherein is included introducing a first supply of fuel gas into said flow of air.

52. A method for operating a venturi tube equipped round burner so as to achieve reduced CO and $NO_x$ emissions, said venturi tube having an inlet end, an outlet end and a throat disposed between said ends, said throat having a lesser internal diameter than either of said ends and being operable when a flow of fluid passes through the venturi tube to create a low pressure zone therein, said venturi tube including a flue gas inlet connection located adjacent said throat to permit induction of recirculated flue gas directly into said low pressure zone, said venturi tube being positioned with its outlet end located adjacent an entrance to a combustion chamber, said entrance having an inner edge, said method comprising:

directing a flow of air through said venturi tube and into a combustion zone in said combustion chamber through said entrance to thereby create a low pressure zone in said venturi tube adjacent said flue gas inlet connection;

injecting a flow of fuel gas into said combustion chamber at a location radially beyond said inner edge of the entrance and adjacent said combustion zone;

using the low pressure in said low pressure zone to induce a recirculation of flue gas from a location in said combustion chamber adjacent said combustion zone, through the flue gas inlet connection and directly into said low pressure zone, whereby recirculated flue gas is intermixed with said flow of air in said low pressure zone; and passing at least a primary portion of said flow of air through a swirler, wherein a secondary portion of said flow of air does not pass through the swirler.

53. A method for operating a venturi tube equipped round burner as set forth in claim 52, wherein is included introducing a first supply of fuel gas into said flow of air.

54. A method for operating a venturi tube equipped round burner as set forth in claim 52, wherein said venturi tube has an outer periphery and an annular gap is provided between said outer periphery at the outlet end of the venturi tube and said inner edge of said entrance, said method including a step of causing a tertiary air stream to flow around the periphery of the venturi tube, through the gap, and into said combustion chamber.

55. A method for operating a venturi tube equipped round burner as set forth in claim 53, wherein said venturi tube has an outer periphery and an annular gap is provided between said outer periphery at the outlet end of the venturi tube and said inner edge of said entrance, said method including a step of causing a tertiary air stream to flow around the periphery of the venturi tube, through the gap, and into said combustion chamber.

56. A method for operating a venturi tube equipped round burner as set forth in claim 53, wherein said first supply of fuel gas is introduced into said primary portion of the flow of air, and a second separate supply of fuel gas is introduced into said secondary portion of the flow of air.

57. A method for operating a venturi tube equipped round burner as set forth in claim 55, wherein said first supply of fuel gas is introduced into said primary portion of the flow of air, and a second separate supply of fuel gas is introduced into said secondary portion of the flow of air.

58. A method for operating a venturi tube equipped round burner so as to achieve reduced CO and $NO_x$ emissions, wherein said venturi tube has an outer periphery, an inlet end, an outlet end, and a throat disposed between said ends, said throat having a lesser internal diameter than either of said ends and being operable when a flow of fluid passes through the venturi tube to create a low pressure zone therein, said venturi tube including a flue gas inlet connection located adjacent said throat to permit induction of recirculated flue gas directly into said low pressure zone, said venturi tube being positioned with its outlet end located adjacent an entrance to a combustion chamber, said entrance having an inner edge, and wherein an annular gap is provided between said outer periphery at the outlet end of the venturi tube and said inner edge of said entrance, said method comprising:

directing a flow of air through said venturi tube and into a combustion zone in said combustion chamber through said entrance to thereby create a low pressure zone in said venturi tube adjacent said flue gas inlet connection;

injecting a flow of fuel gas into said combustion chamber at a location radially beyond said inner edge of the entrance and adjacent said combustion zone;

using the low pressure in said low pressure zone to induce a recirculation of flue gas from a location in said combustion chamber adjacent said combustion zone, through the flue gas inlet connection and directly into said low pressure zone, whereby recirculated flue gas is intermixed with said flow of air in said low pressure zone;

passing at least a primary portion of said flow of air through a swirler; and causing a tertiary air stream to flow around the periphery of the venturi tube, through the gap, and into said combustion chamber.

59. A method for operating a venturi tube equipped round burner as set forth in claim 58, wherein is included introducing a first supply of fuel gas into said flow of air.

60. A round burner capable of reduced CO and $NO_x$ emissions comprising:

a venturi tube positioned to direct a flow of air through the burner and into a combustion zone in a combustion chamber through an entrance in a wall of the combustion chamber, said venturi tube having an inlet and outlet ends and a throat located between said ends, said outlet end having a larger internal diameter than said inlet end and said throat, said outlet end of the venturi tube being positioned adjacent said entrance to the combustion chamber, said inlet end of the venturi tube being positioned further from said entrance than said outlet end of the venturi tube, said venturi tube having a centrally disposed longitudinal axis extending between said ends thereof; and a swirler mounted in the venturi tube disposed at said axis and positioned adjacent said outlet end so that a primary centrally located portion of said flow of air passes through the swirler and a secondary annular portion of said flow which surrounds said primary portion does not pass through the swirler, said venturi tube and said entrance being arranged so that a tertiary air flow is directed around the periphery of the venturi tube and through the entrance into said combustion chamber.

61. A round burner as set forth in claim 60 wherein said venturi tube has an outer periphery and said entrance has an inner annular edge, said periphery and said inner edge defining an annular gap therebetween, said gap being positioned to direct said tertiary air flow around the periphery of the venturi tube and through the entrance into said combustion chamber.

62. A method for operating a venturi tube equipped round burner with reduced CO and $NO_x$ emissions, said venturi tube having an inlet end, an outlet end and a throat disposed between said inlet end and said outlet end, said outlet end of the venturi tube having a larger internal diameter than said inlet end and said throat, said outlet end of the venturi tube being positioned adjacent an entrance to a combustion chamber, said inlet end of the venturi tube being positioned further from said entrance than said outlet end of the venturi tube, said venturi tube having a centrally disposed longitudinal axis extending between said ends thereof, said method comprising:

directing a flow of air through said venturi tube and into a combustion zone in said combustion chamber through said entrance;

passing a primary portion of said flow of air through a swirler located in the venturi tube at said axis and adjacent said outlet;

causing a secondary portion of said flow of air to go through the venturi without passing through the swirler; and inducing a tertiary air stream to flow around the periphery of the venturi tube and into said combustion chamber through said entrance.

63. A method for operating a venturi tube equipped round burner as set forth in claim 62, wherein said venturi tube has an outer periphery and an annular gap is provided between said outer periphery at the outlet end of the venturi tube and an inner edge of said entrance, said inducing step including causing using said tertiary air stream to flow around the periphery of the venturi tube, through the gap, and into said combustion chamber.

64. A method for operating a venturi tube equipped round burner as set forth in claim 62, wherein a first supply of fuel gas is introduced into said primary portion, and a second separate supply of fuel gas is introduced into said secondary portion.

* * * * *

UNITED STATES PATENT AND TRADEMARK OFFICE

CERTIFICATE OF CORRECTION

PATENT NO. : 6,347,935 B1
DATED : February 19, 2002
INVENTOR(S) : Edmund Schindler et al.

It is certified that error appears in the above-identified patent and that said Letters Patent is hereby corrected as shown below:

Column 11,
Line 40, delete “claim 18” and insert -- claim 19 -- therefor.

Column 12,
Line 37, delete “claim 27” and insert -- claim 25 -- therefor.
Line 48, delete “claim 25” and insert -- claim 26 -- therefor.

Column 13,
Line 32, delete “forth-in” and insert -- forth in -- therefor.

Column 14,
Line 23, delete “claim 32” and insert -- claim 40 -- therefor.
Line 39, delete “emissions said” and insert -- emissions, said -- therefor.

Column 15,
Line 2, delete “claim 32” and insert -- claim 39 -- therefor.
Line 39, delete “venture” and insert -- venturi -- therefor.

Signed and Sealed this

Twenty-fourth Day of June, 2003

JAMES E. ROGAN
*Director of the United States Patent and Trademark Office*